US005676167A

United States Patent [19]

Garner

[11] Patent Number: 5,676,167

[45] Date of Patent: Oct. 14, 1997

[54] TOOTHBRUSH AND FLOSS APPARATUS

[76] Inventor: Alan Scott Garner, 11219 R.R. 2222 Box 17, Austin, Tex. 78730

[21] Appl. No.: 644,282

[22] Filed: May 10, 1996

[51] Int. Cl.[6] ..... A45D 44/18

[52] U.S. Cl. ..... 132/309; 132/31

[58] Field of Search ..... 132/309, 311, 132/308; 15/167.1

[56] References Cited

U.S. PATENT DOCUMENTS

| | | | |
|---|---|---|---|
| 695,092 | 3/1902 | Cowan | 132/309 |
| 1,312,896 | 8/1919 | Donnelly | 132/311 |
| 2,113,439 | 4/1938 | Bean | 132/309 |
| 3,850,182 | 11/1974 | Clark, Jr. . | |
| 4,016,891 | 4/1977 | Kupperman et al. . | |
| 4,693,622 | 9/1987 | Booth | 132/311 |
| 4,821,752 | 4/1989 | Widlak | 132/311 |
| 4,887,621 | 12/1989 | Vallieres . | |
| 5,348,028 | 9/1994 | Gustavel | 132/309 |

*Primary Examiner*—Todd E. Manahan
*Assistant Examiner*—Eduardo C. Robert

[57] ABSTRACT

A toothbrush and floss apparatus includes a toothbrush assembly that includes a brush assembly supported by a handle which includes a brush end and a floss-supporting end. A detachable dental floss assembly is attached to the floss-supporting end of the handle and includes a floss-assembly-based connector for connecting the dental floss assembly to the floss-supporting end of the handle. The brush assembly and the brush end and the floss-supporting end of the handle are located along a common longitudinal axis. The dental floss assembly includes a housing which includes a proximal end and a distal end. The floss-assembly-based connector is located at the proximal end of the housing, and the floss-assembly-based connector is detachably connected to a complementary handle-based connector located on the floss-supporting end of the hand embodiment, the floss-assembly-based connector and the handle-based connector are connected together by a connection action along the longitudinal axis. In another embodiment, dental floss assembly is connected to the handle by a connection action transverse to the longitudinal axis. In both embodiments, the housing includes a hinged cap located on the housing allowing access to the dental floss.

2 Claims, 3 Drawing Sheets

TOOTHBRUSH AND FLOSS APPARATUS

BACKGROUND OF THE INVENTION

1. Field of the Invention

The present invention relates generally to toothbrushes and dental floss devices and, more particularly, to a device which combines both a toothbrush and a dental floss device.

2. Description of the Prior Art

Throughout the years, a number of innovations have been developed relating to toothbrushes that also include dental floss devices, and the following U.S. patents are representative of some of those innovations: U.S. Pat. Nos. 3,850,182, 4,016,891, and 4,887,621. More specifically, each of U.S. Pat. Nos. 3,850,182 and 4,016,891 discloses a toothbrush which has a dental floss holder located at the distal end of the handle. The dental floss holder has a pair of spaced arms across which a quantity of dental floss extends. The quantity of dental floss that extends across the pair of spaced arms is intended to be placed inside and person's mouth to directly contact the person's teeth. When a person uses the quantity of dental floss between the pair of spaced arms, there is strong likelihood that some of the person's saliva will contaminate portions of the dental floss that are stored in the dental floss holder and that are not between the pair of spaced arms. Such contaminated dental floss can be a breeding area for unwanted germs. In this respect, it would be desirable if a toothbrush handle supported a dental floss device that does not include a quantity of dental floss that is supported by a pair of spaced arms that are put inside a person's mouth.

U.S. Pat. No. 4,887,621 discloses a combination toothbrush and dental floss holder which includes a relatively wide diameter handle and includes a spool of dental floss housed within the handle. A removable cap covers and protects dental floss and the cutting blade for the dental floss. It may be difficult to adequately grasp the wide diameter handle, and it may be difficult to control the wide diameter handle during brushing. In this respect, it would be desirable if a toothbrush handle which supported a dental floss device does not include a relatively wide diameter handle.

Still other features would be desirable in a device which combines both a toothbrush and a dental floss device. For example, if it were desirable to remove the dental floss device from the toothbrush handle, it would be desirable if the dental floss device were detachable from the toothbrush handle. Moreover, for convenience in selectively employing a detachable dental floss device, it would be desirable if the detachable dental floss device can be attached to the toothbrush handle using a snap fit.

Thus, while the foregoing body of prior art indicates it to be well known to use a device which combines both a toothbrush and a dental floss device, the prior art desert bed above does not teach or suggest a toothbrush and floss apparatus which has the following combination of desirable features: (1) does not include a quantity of dental floss that is supported by a pair of spaced arms that are put inside a person's mouth; (2) does not include a relatively wide diameter handle; (3) provides a dental floss device which is detachable from the toothbrush handle; and (4) can be attached to the toothbrush handle using a snap fit. The foregoing desired characteristics are provided by the unique toothbrush and floss apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a toothbrush and floss apparatus which includes a toothbrush assembly that includes a brush assembly supported by a handle which includes a brush end and a floss-supporting end. A detachable dental floss assembly is attached to the floss-supporting end of the handle and includes a floss-assembly-based connector for connecting the dental floss assembly to the floss-supporting end of the handle. The brush assembly and the brush end and the floss-supporting end of the handle are located along a common longitudinal axis.

The dental floss assembly includes a housing which includes a proximal end and a distal end. The floss-assembly-based connector is located at the proximal end of the housing, and the floss-assembly-based connector is detachably connected to a complementary handle-based connector located on the floss-supporting end of the handle. The floss-assembly-based connector and the handle-based connector are connected together by a connection action along the longitudinal axis. The handle-based connector can be in a form of a pair of protuberances that project laterally from the floss-supporting end of the handle, and the floss-assembly-based connector can be in a form of a pair of complimentary depressions located in the proximal end of the housing of the dental floss assembly.

The housing includes a hinged cap located at the distal end of the housing. The housing includes a locking peg for locking the hinged cap in a dosed position. The housing includes a floss cuter, and the floss cuter is located along the longitudinal axis.

The proximal end of the housing includes a front floss-assembly-based connector. The distal end of the housing includes a rear floss-assembly-based connector. The floss-supporting end of the handle includes a homing-receiving well. The housing-receiving well includes a front well-based connector which is complimentary to the front floss-assembly-based connector. The housing-receiving well includes a rear well-based connector which is complimentary to the rear floss-assembly-based connector. The front floss-assembly-based connector and the from well-based connector are connected together by a connection action transverse to the longitudinal axis, and the rear floss-assembly-based connector and the rear well-based connector are connected together by a connection action transverse to the longitudinal axis.

The front floss-assembly-based connector can be in a form of a front protuberance, and the front well-based connector can be in a form of a complimentary front depression. The rear floss-assembly-based connector can be in a form of a rear protuberance, and the rear well-based connector can be in a form of a rear depression.

The housing includes a hinged cap located at the proximal end of the housing. The hinged cap includes a floss-cutter portion, and the floss-cutter portion is located along a line parallel to the longitudinal axis.

The above brief description sets forth rather broadly the more important features of the present invention in order that the detailed description thereof that follows may be better understood, and in order that the present contributions to the art may be better appreciated. There are, of course, additional features of the invention that will be desert bed hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush and floss apparatus which has all of the advantages of the prior art and none of the disadvantages.

It is another object of the present invention to provide a new and improved toothbrush and floss apparatus which may be easily and efficiently manufactured and marketed.

It is a further object of the present invention to provide a new and improved toothbrush and floss apparatus which is of durable and reliable construction.

An even further object of the present invention is to provide a new and improved toothbrush and floss apparatus which is susceptible of a low cost of manufacture with regard to both materials and labor, and which accordingly is then susceptible of low prices of sale to the consuming public, thereby making such toothbrush and floss apparatus available to the buying public.

Still yet a further object of the present invention is to provide a new and improved toothbrush and floss apparatus which does not include a quantity of dental floss that is supported by a pair of spaced arms that are put inside a person's mouth.

Still another object of the present invention is to provide a new and improved toothbrush and floss apparatus that does not include a relatively wide diameter handle.

Yet another object of the present invention is to provide a new and improved toothbrush and floss apparatus which provides a dental floss device which is detachable from the toothbrush handle.

Even another object of the present invention is to provide a new and improved toothbrush and floss apparatus that has a dental floss device that can be attached to the toothbrush handle using a snap fit.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a perspective view of a second embodiment of the toothbrush and floss apparatus of the invention.

DESCRIPTION OF THE PREFERRED EMBODIMENT

Figure 1:
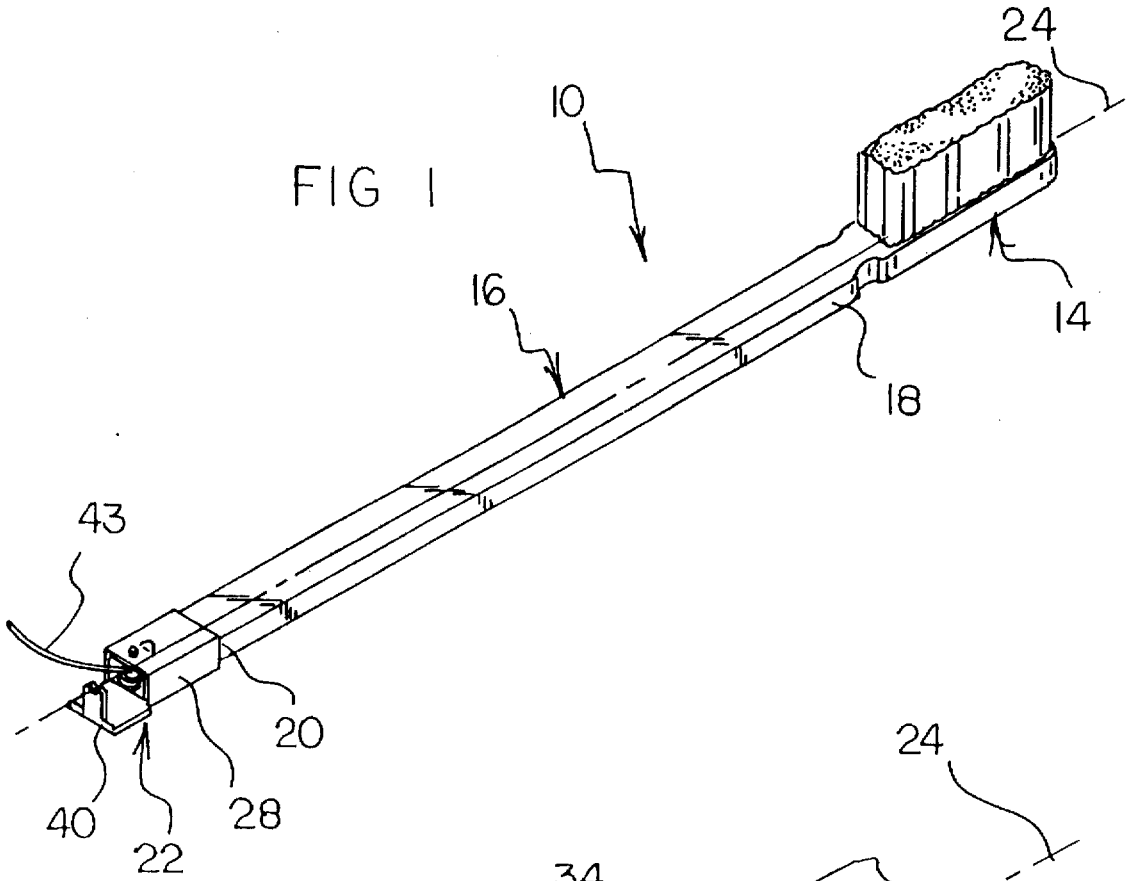
FIG. 1 is a perspective view showing a first embodiment of the toothbrush and floss apparatus of the invention.

With reference to the drawings, a new and improved toothbrush and floss apparatus embodying the principles and concepts of the present invention will be described.

Turning to Figures, there are shown two exemplary embodiments of the toothbrush and floss apparatus of the invention generally designated by reference numeral 10. In each embodiment, a toothbrush and floss apparatus 10 includes a toothbrush assembly that includes a brush assembly 14 supported by a handle 16 which includes a brush end 18 and a floss-supporting end 20. A detachable dental floss assembly 22 is attached to the floss-supporting end 20 of the handle 16 and includes a floss-assembly-based connector for connecting the dental floss assembly 22 to the floss-supporting end 20 of the handle 16. The brush assembly 14 and the brush end 18 and the floss-supporting end 20 of the handle 16 are located along a common longitudinal axis 24.

Figure 2:
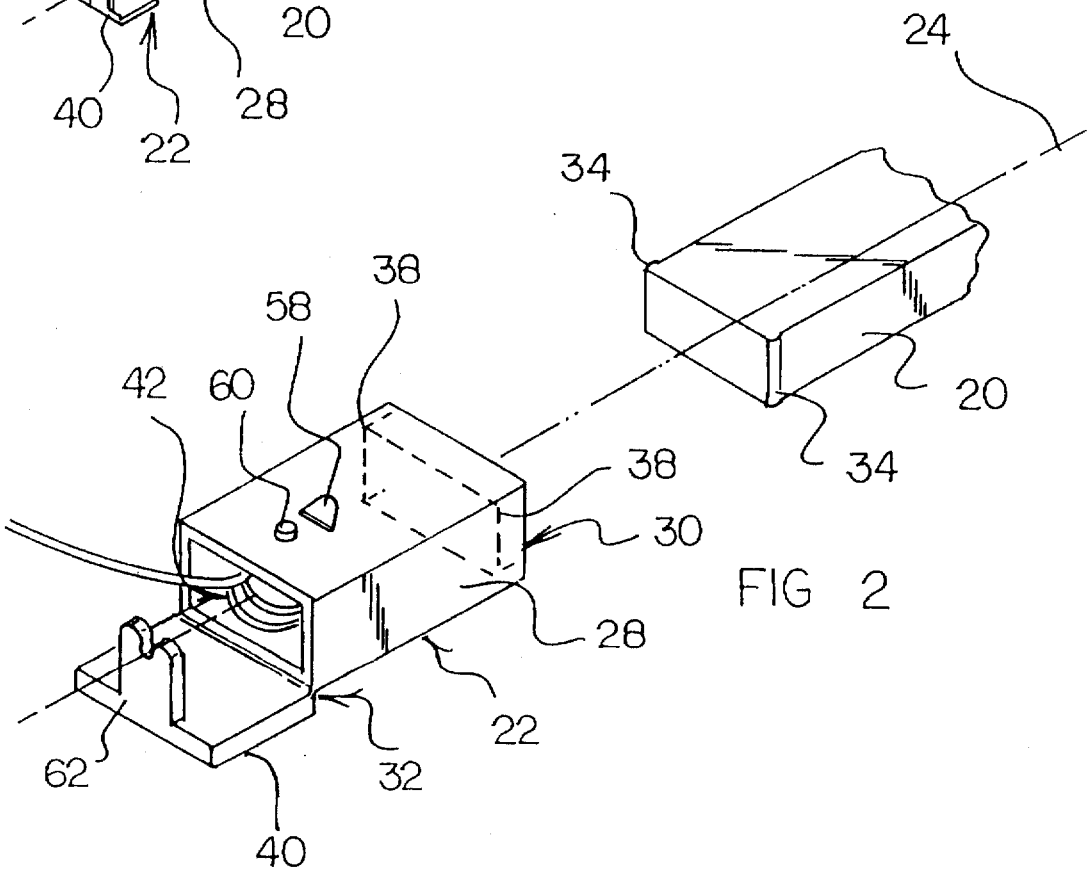
FIG. 2 is an enlarged, partially exploded perspective view of a portion of the embodiment of the invention shown in FIG. 1.

As shown in FIGS. 1 and 2, in accordance with the first embodiment of the invention, the dental floss assembly 22 includes a homing 28 which includes a proximal end 30 and a distal end 32. The floss-assembly-based connector is located at the proximal end 30 of the housing 28, and the floss-assembly-based connector is detachably connected to a complementary handle-based connector located on the floss-supporting end 20 of the handle 16. The floss-assembly-based connector and the handle-based connector are connected together by a connection action along the longitudinal axis 24. The handle-based connector can be in a form of a pair of protuberances 34 that project laterally from the floss-supporting end 20 of the handle 16, and the floss-assembly-based connector can be in a form of a pair of complimentary depressions 38 located in the proximal end 30 of the housing 28 of the dental floss assembly 22. The depressions 38 receive the protuberances 34 in a snap action manner when the dental floss assembly 22 is connected to the floss-supporting end 20 of the handle 16. The snap action is provided by flexible plastic snap action components.

The housing 28 includes a hinged cap 40 located at the distal end 32 of the housing 28. A spool 42 of dental floss 43 is retained inside the housing 28. The housing 28 includes a locking peg 60 for locking the hinged cap 40 in a closed position. The locking peg 60 engages a complimentary peg receiver 62 on the hinged cap 40. The housing 28 includes a floss cutter 58, and the floss cutter 58 is located along the longitudinal axis 24.

In using the first embodiment of the invention, the dental floss assembly 22 is in the form of a modular unit that can be snapped onto the floss-supporting end 20 of the handle 16 by engaging the protuberances 34 on the floss-supporting end 20 with the depressions 38 in the housing 28 of the dental floss assembly 22. The dental floss assembly 22 is connected to and disconnected from the handle 16 by moving the dental floss assembly 22 with respect to the handle 16 parallel to the longitudinal axis 24. To use dental floss 43, the hinged cap 40 is lifted off of the top of the housing 28 by disengaging the peg receiver 62 from the locking peg 60. Then the desired amount of dental floss 43 is pulled off of the spool 42, and the dental floss 43 is cut on the floss cutter 58. When the dental floss 43 is depleted from the spool 42, the entire dental floss assembly 22 is detached from the handle 16 and replaced with another dental floss assembly 22 that has a new spool 42.

Alternatively, if desired, the dental floss assembly 22 can be connected to the floss-supporting end 20 of the handle 16 by a simple friction fit using a wedging action between the dental floss assembly 22 and the floss-supporting end 20.

Turning to FIGS. 3–6, a second embodiment of the invention is shown. Reference numerals are shown that correspond to like reference numerals that designate like elements shown in the other figures. In addition, the proximal end 30 of the housing 28 includes a front floss-assembly-based connector. The distal end 32 of the housing 28 includes a rear floss-assembly-based connector. The floss-supporting end 20 of the handle 16 includes a housing-receiving well 48. The homing-receiving well 48 includes a front well-based connector which is complimentary to the front floss-assembly-based connector. The housing-receiving well 48 includes a rear well-based connector which is complimentary to the mar floss-assembly-based connector. The front floss-assembly-based connector and the front well-based connector are connected together by a connection action transverse to the longitudinal axis 24, and the rear floss-assembly-based connector and the rear well-based connector are connected together by a connection action transverse to the longitudinal axis 24.

Figure 4:
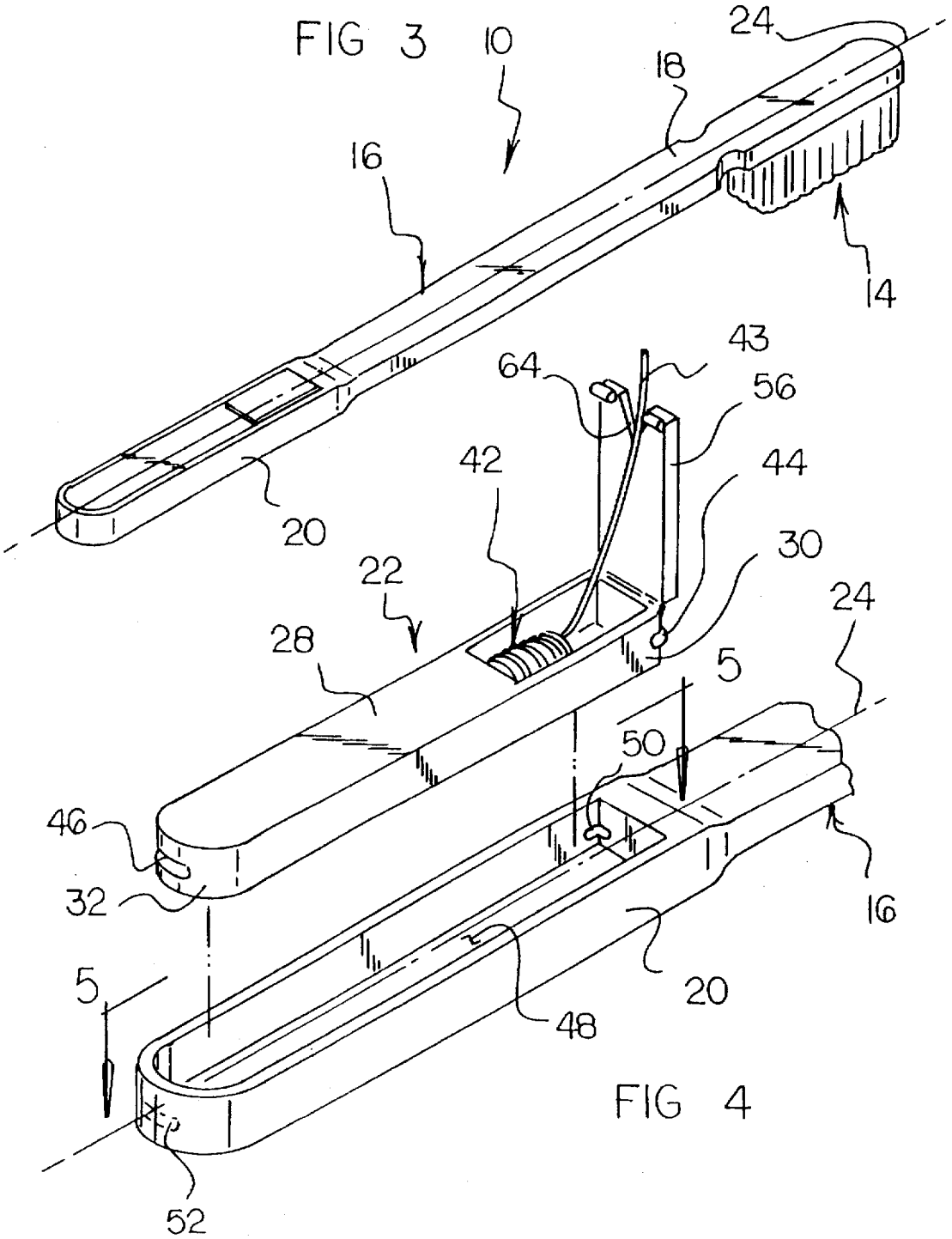
FIG. 4 is an enlarged, partially exploded perspective view of a portion of the embodiment of the invention shown in FIG. 3.
Figure 5:
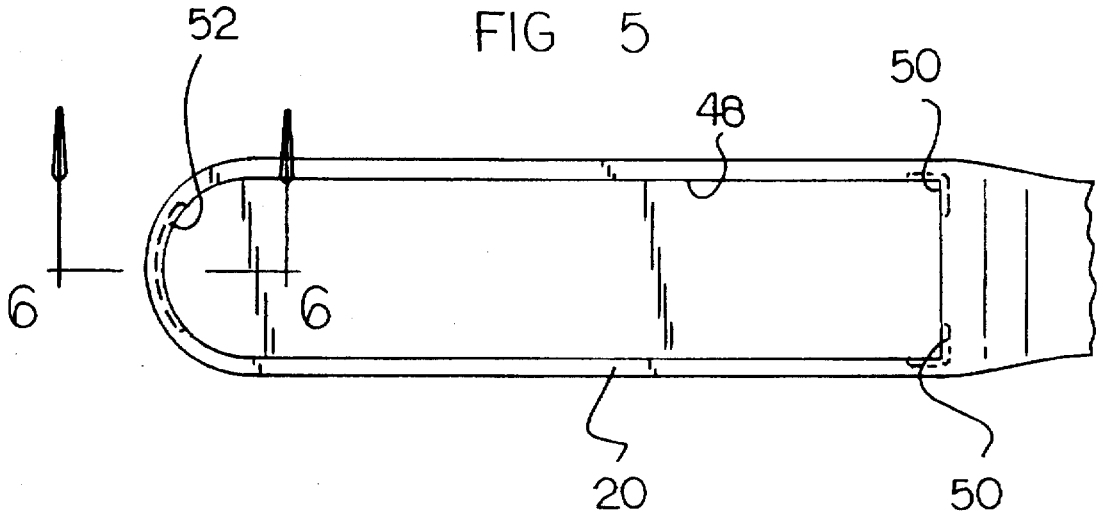
FIG. 5 is a top view of a portion of the embodiment of the invention shown in FIG. 4 taken along line 5—5 thereof.
Figure 6:
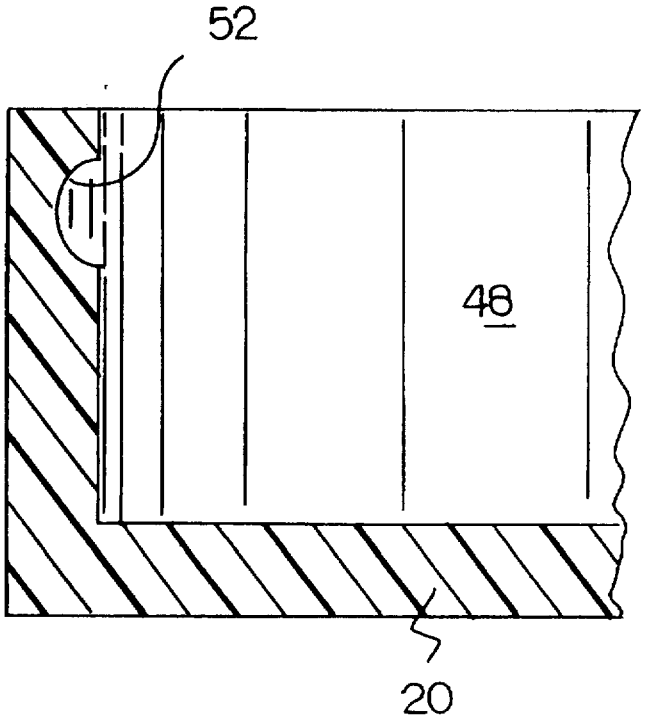
FIG. 6 is an enlarged, partial cross-sectional view of the embodiment of the invention shown in FIG. 5 taken along line 6—6 thereof.

The front floss-assembly-based connector can be in a form of a front protuberance 44, and the front well-based connector can be in a form of a complimentary front depression 50. The rear floss-assembly-based connector can be in a form of a rear protuberance 46, and the rear well-based connector can be in a form of a rear depression 52. Preferably, and as shown in FIG. 4, the handle 16 is made of a flexible plastic and the housing-receiving well 48 includes an interior front wall, a curved interior rear wall, an interior floor wall, and a pair of spaced and parallel interior side walls extending along opposed sides of the floor wall and between the front wall and the rear wall (not labeled). The housing-receiving well 48 is also shaped so as to define at least one front depression extending into the interior front wall and into one of said interior side walls. Similarly, the flexible plastic dental floss housing 28 includes an exterior front wall, a curved exterior rear wall, an exterior top wall, and a pair of spaced and parallel exterior side walls extending along opposed sides of the top wall and between the exterior front wall and the exterior rear wall (not labeled). The dental floss housing 28 is positioned transverse to the longitudinal axis within said housing-receiving well 48 such that the exterior side walls abut the interior side walls, the exterior front wall abuts the interior front wall, the exterior rear wall abuts the interior rear wall, and the top wall is flush with upper edges of the interior side walls. Further, the front protuberance 44 preferably extends from both the exterior front wall and one of the exterior side walls of the dental floss housing. The protuberances 44 and 46 are removably snapped into the respective depressions 50 and 52 to removably couple the housing within the well 48.

The housing 28 includes a hinged cap 56 located at the proximal end 30 of the housing 28. The hinged cap 56 includes a floss-cutter portion 64, and the floss-cutter portion 64 is located along a line parallel to the longitudinal axis 24.

In using the second embodiment of the invention, the dental floss assembly 22 is in modular form and is connected to and disconnected from the floss-supporting end 20 of the handle 16 by moving the dental floss assembly 22 with respect to the handle 16 in a manner that is perpendicular to the longitudinal axis 24. To insert the dental floss assembly 22 in the floss-supporting end 20 of the handle 16, the dental floss assembly 22 is lowered into the housing-receiving well 48, the front protuberances 44 on the housing 28 engage complimentary front depressions 50 in the wall of the housing-receiving well 48, and the rear protuberance 46 on the housing 28 engages complimentary rear depressions 52 in the wall of the housing-receiving well 48.

To use dental floss 43, the hinged cap 56 is lifted, dental floss 43 is pulled off of the spool 42, and a desired quantity of dental floss 43 is cut on the floss-cutter portion 64 of the hinged cap 56. When the dental floss 43 is depleted from the spool 42, the entire dental floss assembly 22 is lifted out of the housing-receiving well 48 and is replaced with a dental floss assembly 22 that has a full spool 42. Preferably, the front protuberances 44 and the front depressions 50 interact in a snap action. Similarly, the rear protuberance 46 and the rear depression 52 interact in a snap action. The snap action is provided by employing flexible plastic snap action components.

The components of the toothbrush and floss apparatus of the invention be made from inexpensive and durable plastic and metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved toothbrush and floss apparatus that is low in cost, relatively simple in design and operation, and which may advantageously be used without including a quantity of dental floss that is supported by a pair of spaced arms that are put inside a person's mouth. With the invention, a toothbrush and floss apparatus is provided which does not include a relatively wide diameter handle. With the invention, a toothbrush and floss apparatus provides a dental floss device which is detachable from the toothbrush handle. With the invention, a toothbrush and floss apparatus is provided which includes a dental floss device which can be attached to the toothbrush handle using a snap fit.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by letters patent of the United States is as follows:

1. A toothbrush and floss apparatus comprising:

a flexible plastic handle including a brush end and a floss-supporting end located along a common longitudinal axis, said floss-supporting end of said handle being shaped so as to define a housing-receiving well, said housing-receiving well including an interior front wall, a curved interior rear wall, an interior floor wall, and a pair of spaced and parallel interior side walls extending along opposed sides of the floor wall and between the front wall and the rear wall, said housing-receiving well being shaped so as to define a front depression extending into said interior front wall and one of said interior side walls, and a rear depression extending into said interior rear wall;

a brush assembly mounted to said brush end of said handle;

a flexible plastic dental floss housing including an exterior front wall, a curved exterior rear wall, an exterior top wall, and a pair of spaced and parallel exterior side walls extending along opposed sides of the top wall and between the exterior front wall and the exterior rear wall, said dental floss housing further including a proximal end and a distal end, said dental floss housing being positioned transverse to the longitudinal axis within said housing-receiving well such that said exterior side walls abut said interior side walls, said exterior front wall abuts said interior front wall, said exterior rear wall abuts said interior rear wall, and said top wall is flush with upper edges of said interior side walls;

a front protuberance extending from said exterior front wall and from one of said exterior side walls of said dental floss housing, said front protuberance being removably snapped into said front depression;

a rear protuberance extending from said exterior rear wall of said dental floss housing, said rear protuberance being removably snapped into said rear depression.

2. The apparatus of claim 1 wherein said housing includes a hinged cap located at said proximal end of said housing, said cap having a floss-cutter portion.

* * * * *